US010835101B2

(12) United States Patent
Singh

(10) Patent No.: US 10,835,101 B2
(45) Date of Patent: Nov. 17, 2020

(54) DRAINING SYSTEM FOR WET OBJECTS ON SINGLE AND MULTI LEVEL TRAYS

(71) Applicant: Mandeep Singh, Kitchener (CA)

(72) Inventor: Mandeep Singh, Kitchener (CA)

( * ) Notice: Subject to any disclaimer, the term of this patent is extended or adjusted under 35 U.S.C. 154(b) by 0 days.

(21) Appl. No.: 16/258,595

(22) Filed: Jan. 26, 2019

(65) Prior Publication Data

US 2019/0298148 A1 Oct. 3, 2019

Related U.S. Application Data

(60) Provisional application No. 62/650,598, filed on Mar. 30, 2018.

(51) Int. Cl.
*A47L 23/20* (2006.01)
*A47L 19/04* (2006.01)

(52) U.S. Cl.
CPC ..... *A47L 23/20* (2013.01); *A47L 19/04* (2013.01)

(58) Field of Classification Search
CPC ..... A47L 23/20; A47L 23/205; A47L 19/04
See application file for complete search history.

(56) References Cited

U.S. PATENT DOCUMENTS 2,729,341 A * 1/1956 Freeman ..... A43D 117/00 211/37
2,847,127 A * 8/1958 Glassenberg ..... A47L 23/20 211/34
3,170,415 A * 2/1965 Svilokos ..... F16B 12/12 108/27
5,016,364 A * 5/1991 Cochrane ..... A47L 23/20 34/195
5,782,368 A * 7/1998 Roberge ..... A47B 61/04 108/24
6,491,170 B1 * 12/2002 Madela ..... A47L 19/04 211/41.3
7,178,680 B2 * 2/2007 Botner ..... A47B 43/00 108/163
7,766,174 B2 * 8/2010 Abraitis ..... A47L 23/20 211/36
9,364,084 B2 * 6/2016 Rege ..... A47B 61/04
9,649,010 B2 * 5/2017 Oh ..... A47J 47/16
2005/0205499 A1 * 9/2005 Botner ..... A47B 43/00 211/34
2006/0091087 A1 * 5/2006 Belanger ..... A47B 61/04 211/37
2006/0213843 A1 * 9/2006 Botner ..... A47L 23/20 211/34
2008/0073300 A1 * 3/2008 Abraitis ..... A47B 61/04 211/36
2012/0151789 A1 * 6/2012 Hurst ..... A47L 23/20 34/202

* cited by examiner

*Primary Examiner* — Stanton L Krycinski

(57) ABSTRACT

A draining system comprising a single or multi-layer tray designed to store and dry wet objects like winter boots, rain boots or dishes that are placed on the tray. This system provides effective utilization of space to store wet objects. Water from the wet objects placed on the tray goes into waste collection bin which can easily be removed without disrupting the tray set-up to dispense waste water without creating a mess.

15 Claims, 21 Drawing Sheets

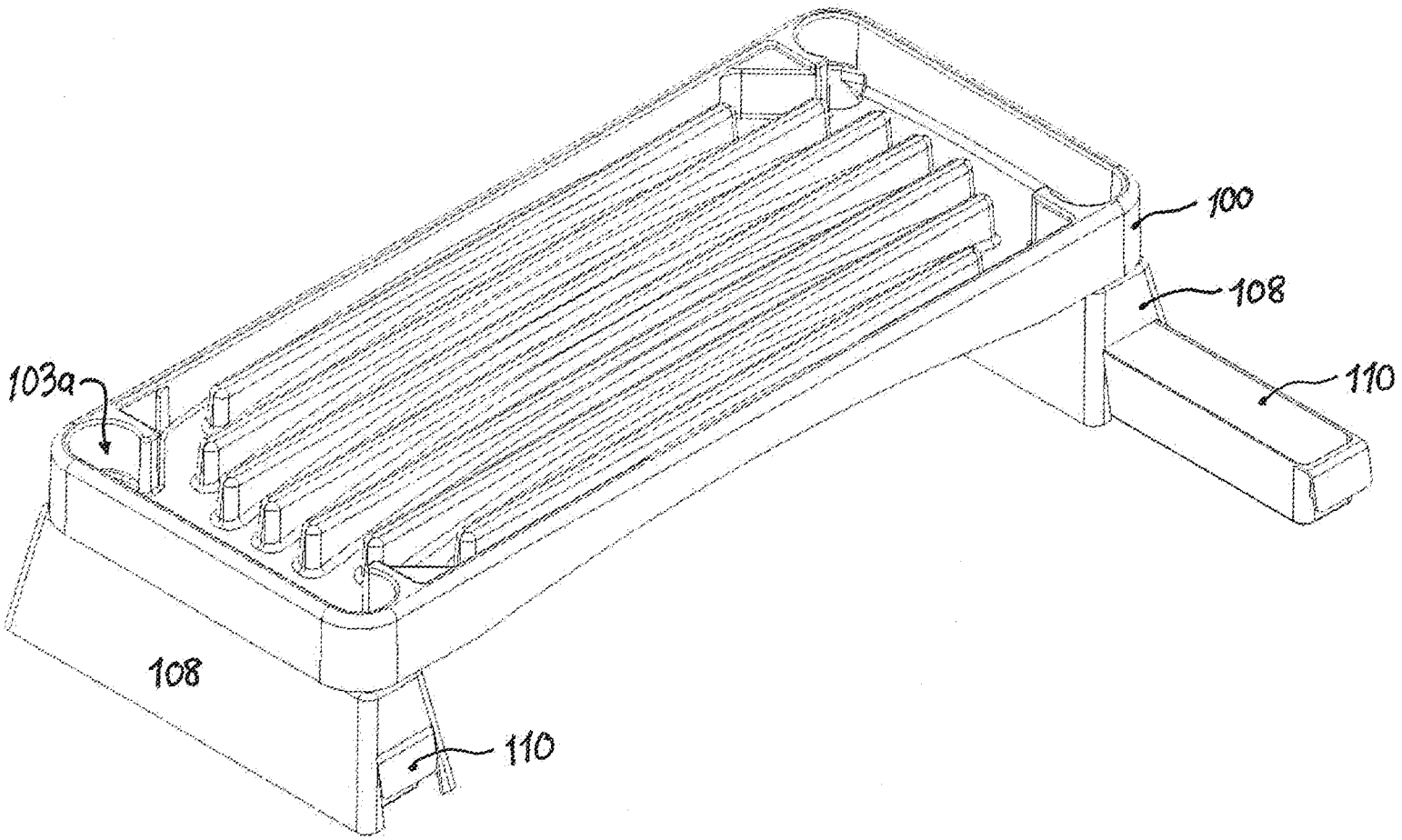
-Fig.6-

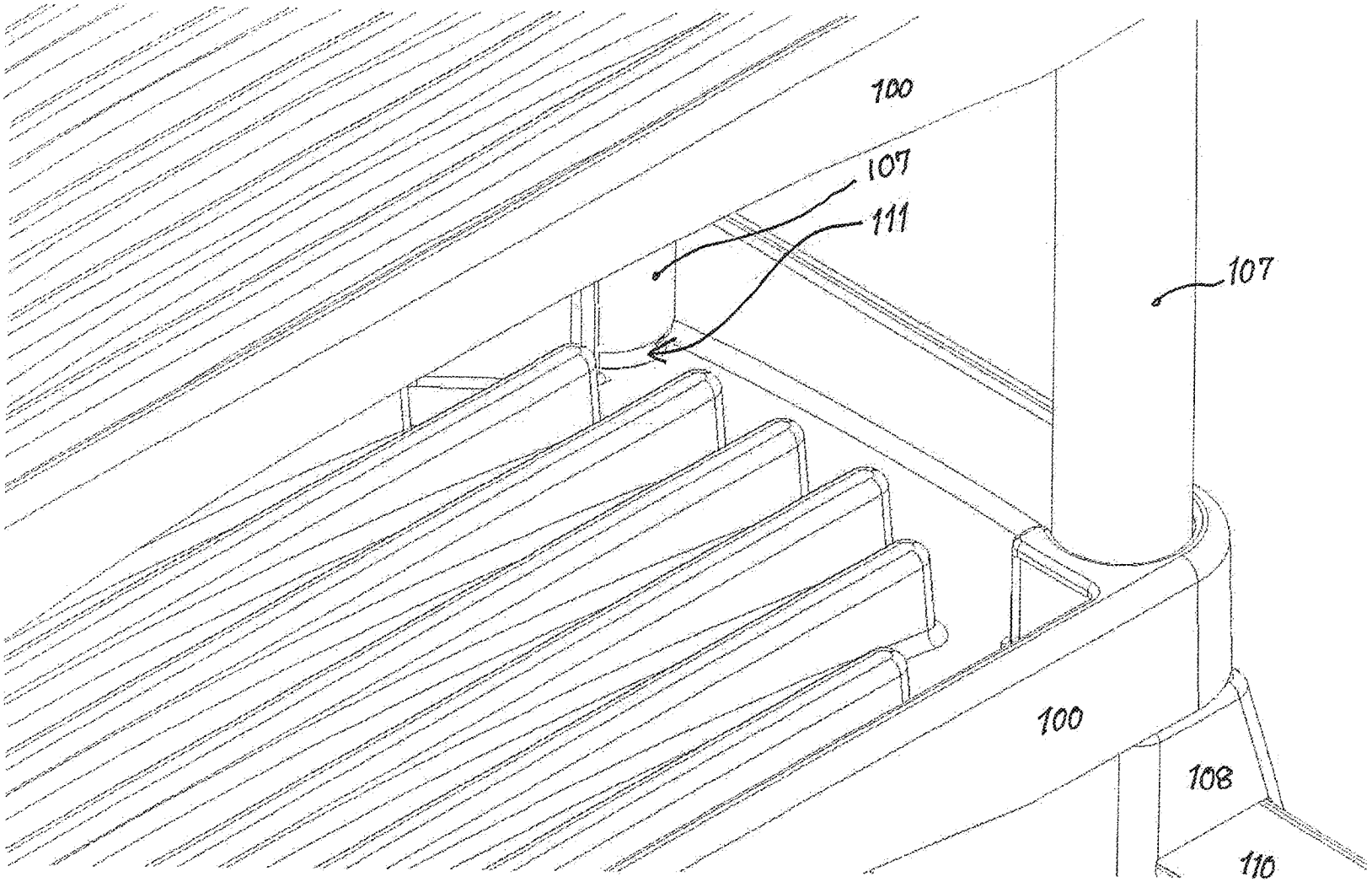
-Fig.8-

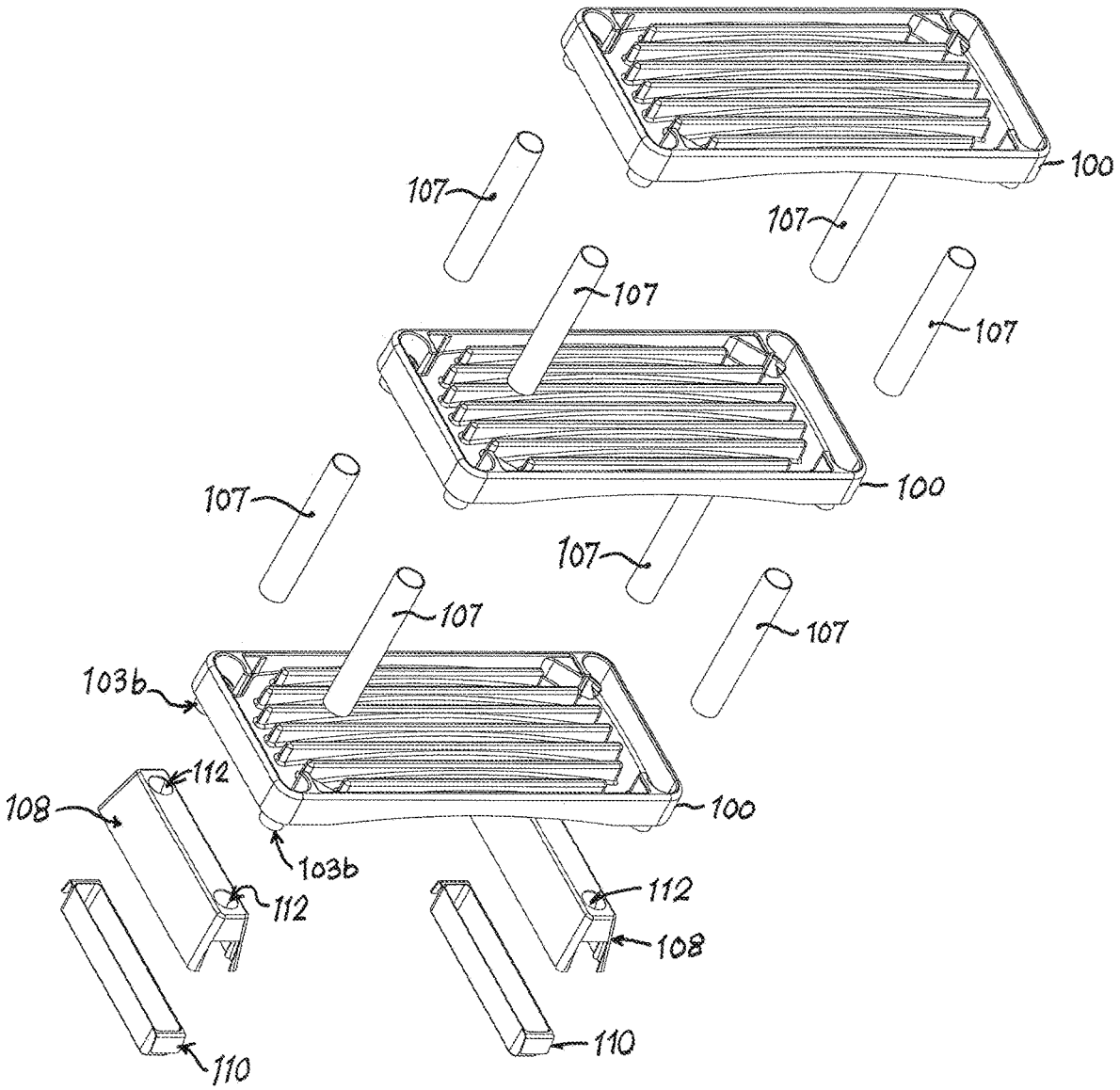
-Fig. 9-

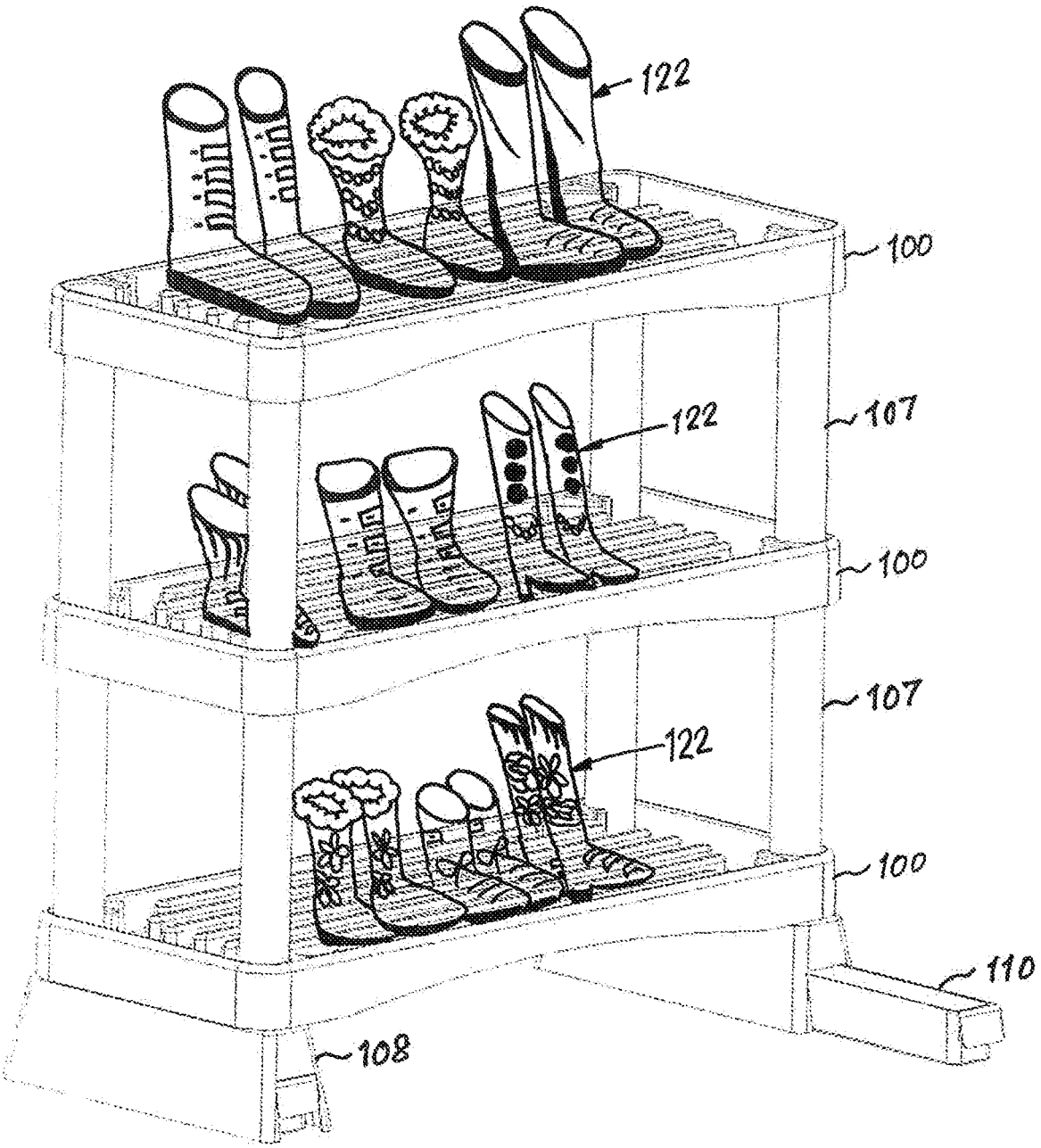
-Fig.10-

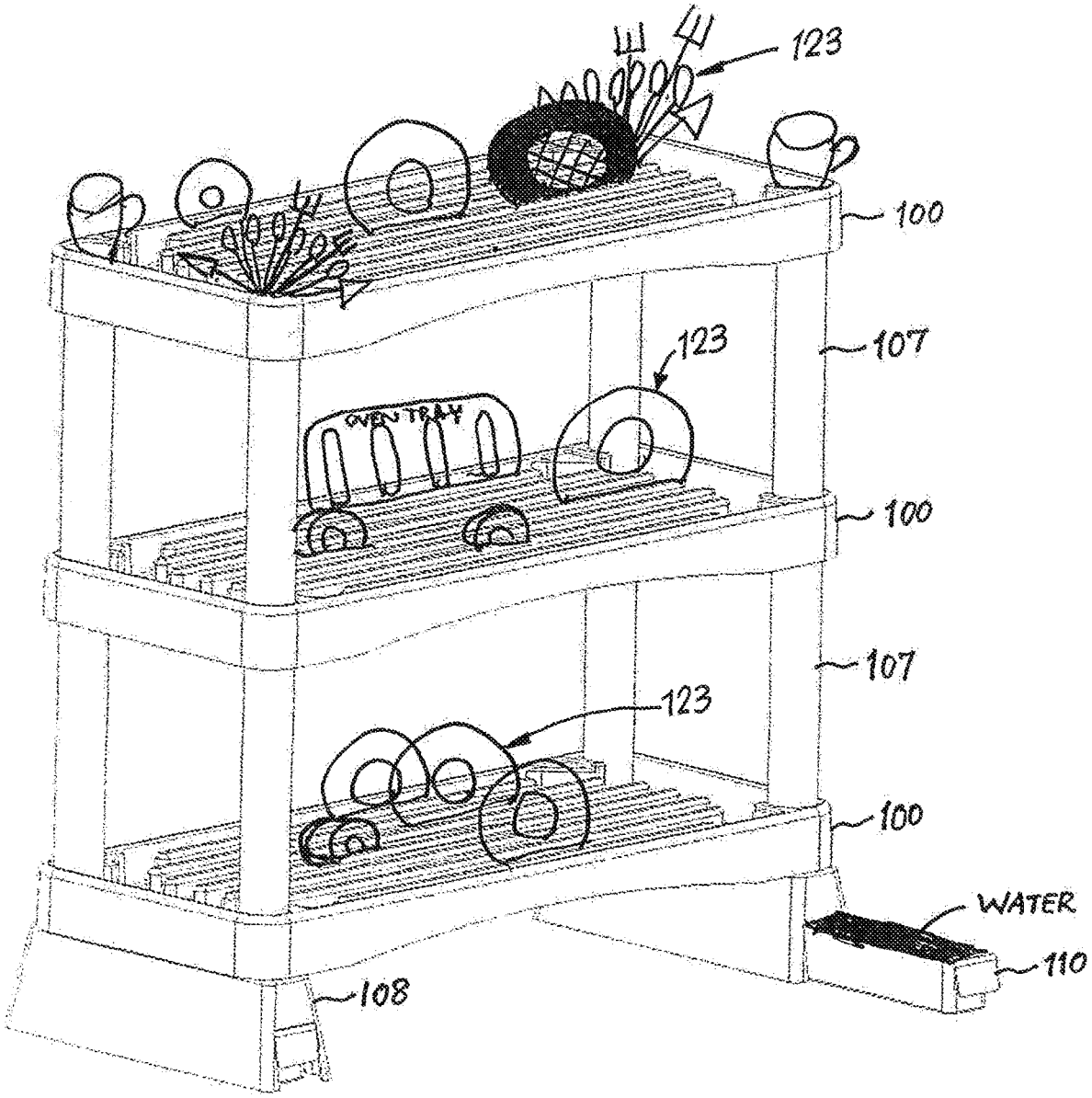
-Fig. 11-

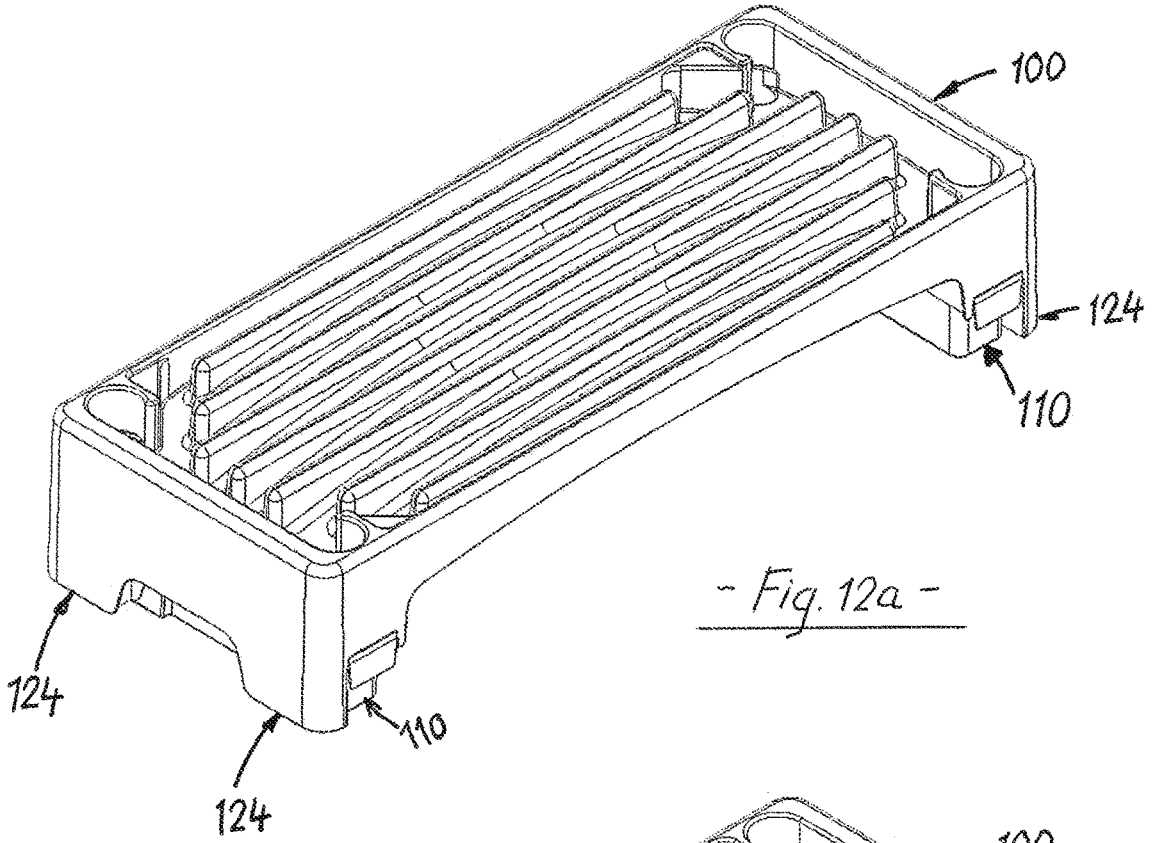
- Fig. 12a -
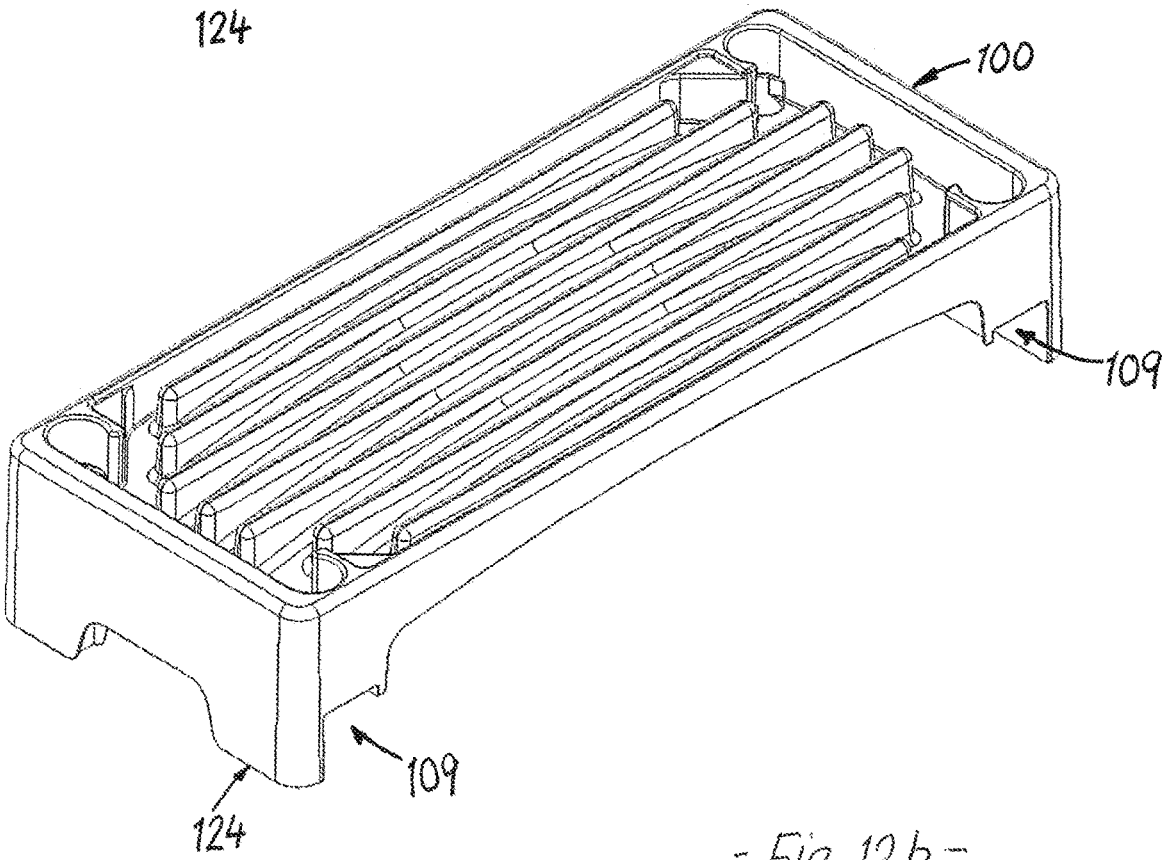
- Fig. 12b -

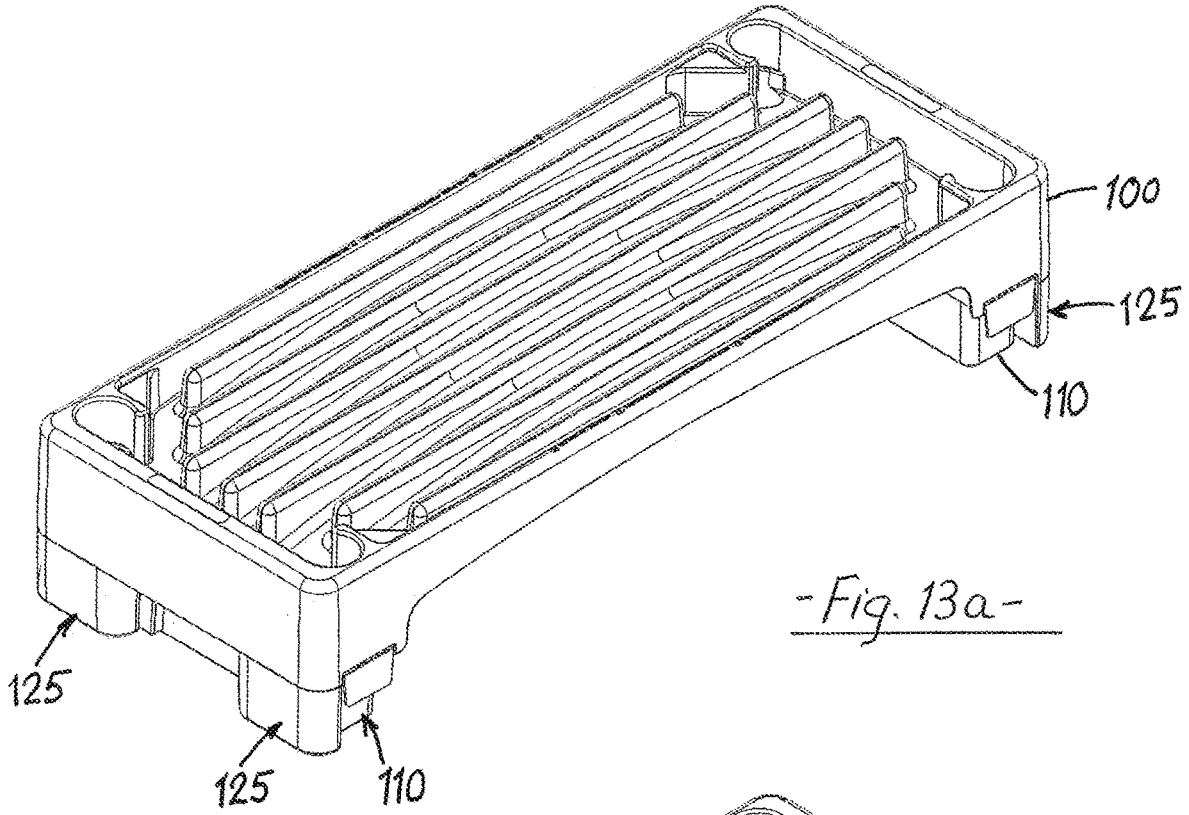
-Fig. 13a-
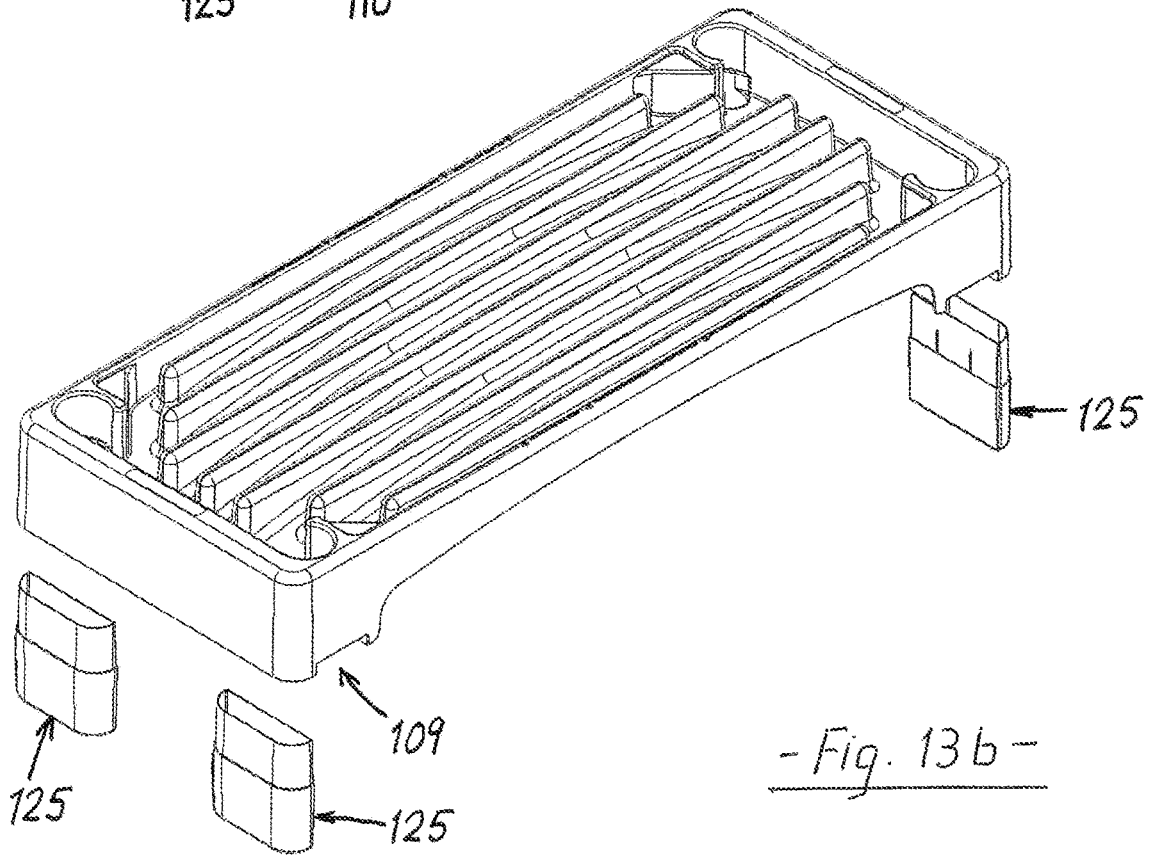
-Fig. 13b-

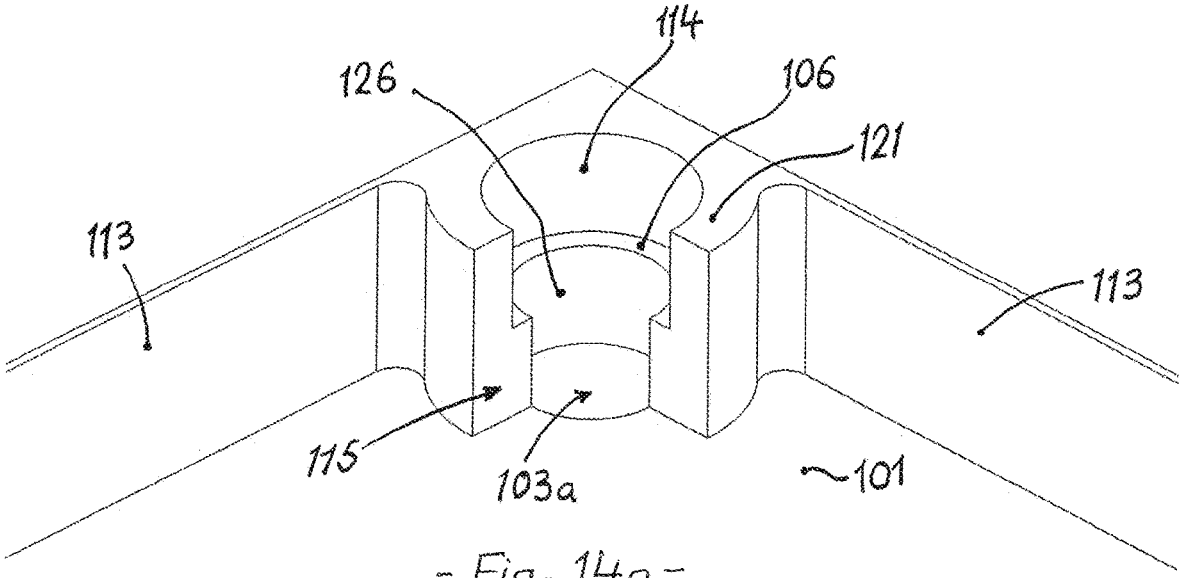
- Fig. 14a -
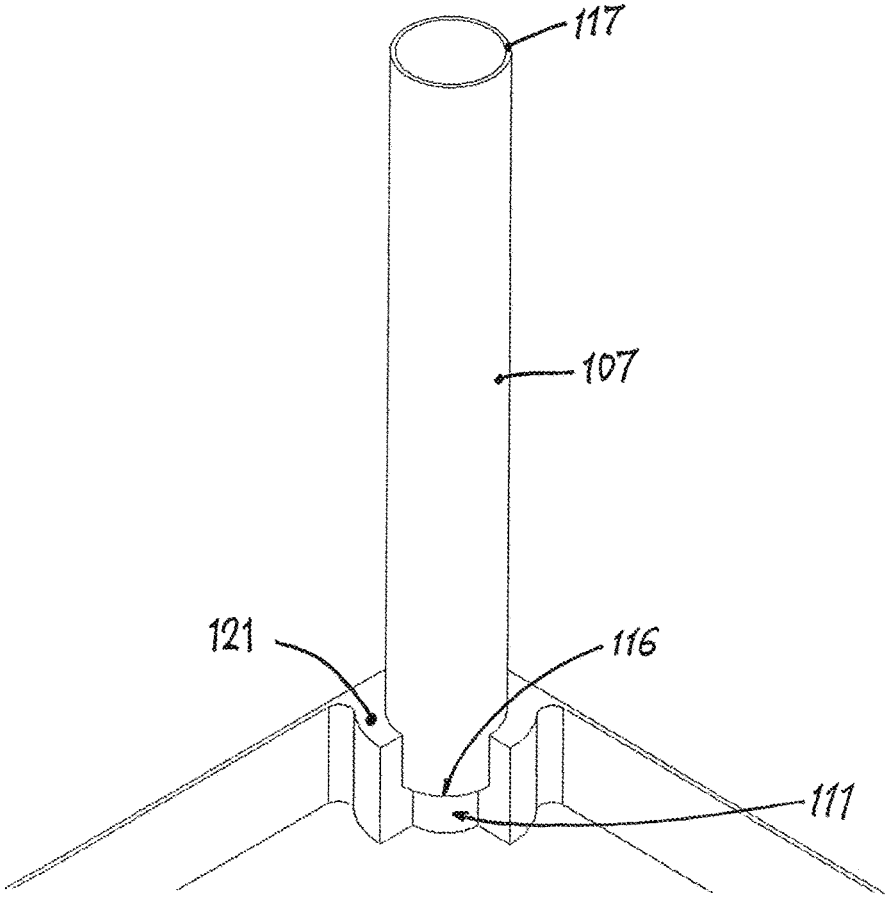
- Fig. 14b -

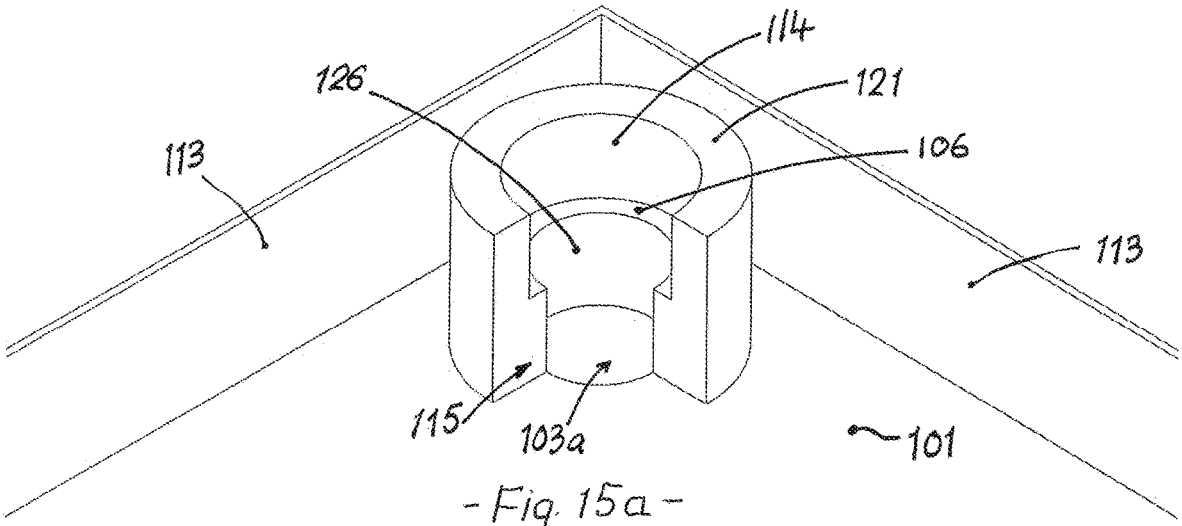
- Fig. 15a -
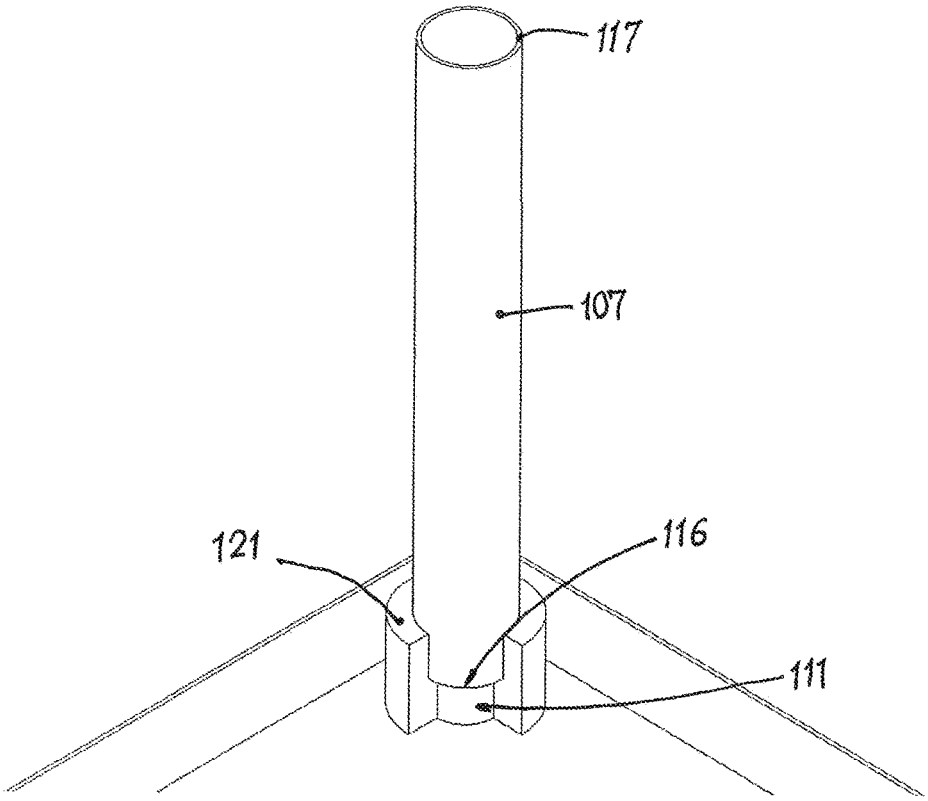
- Fig. 15b -

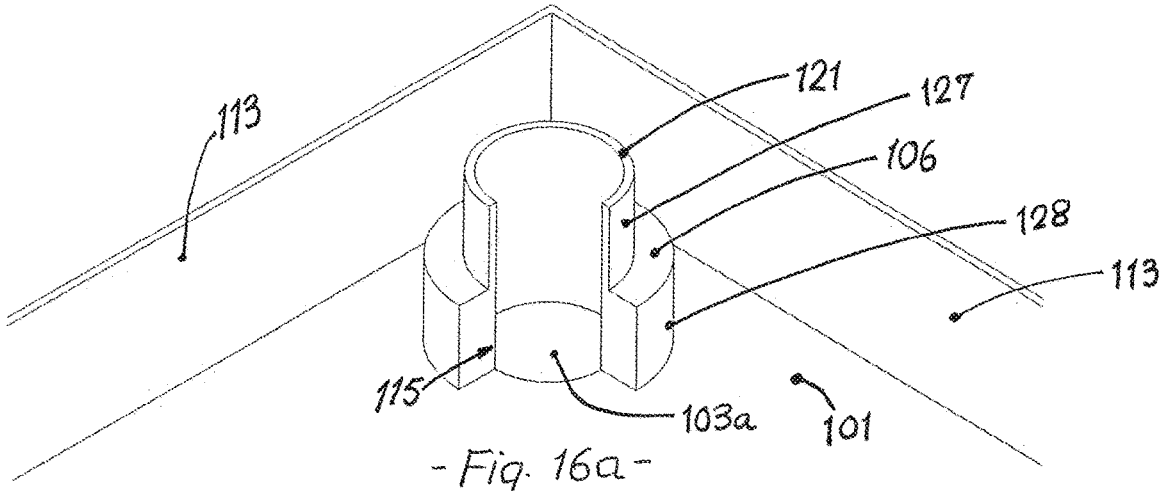
- Fig. 16a -
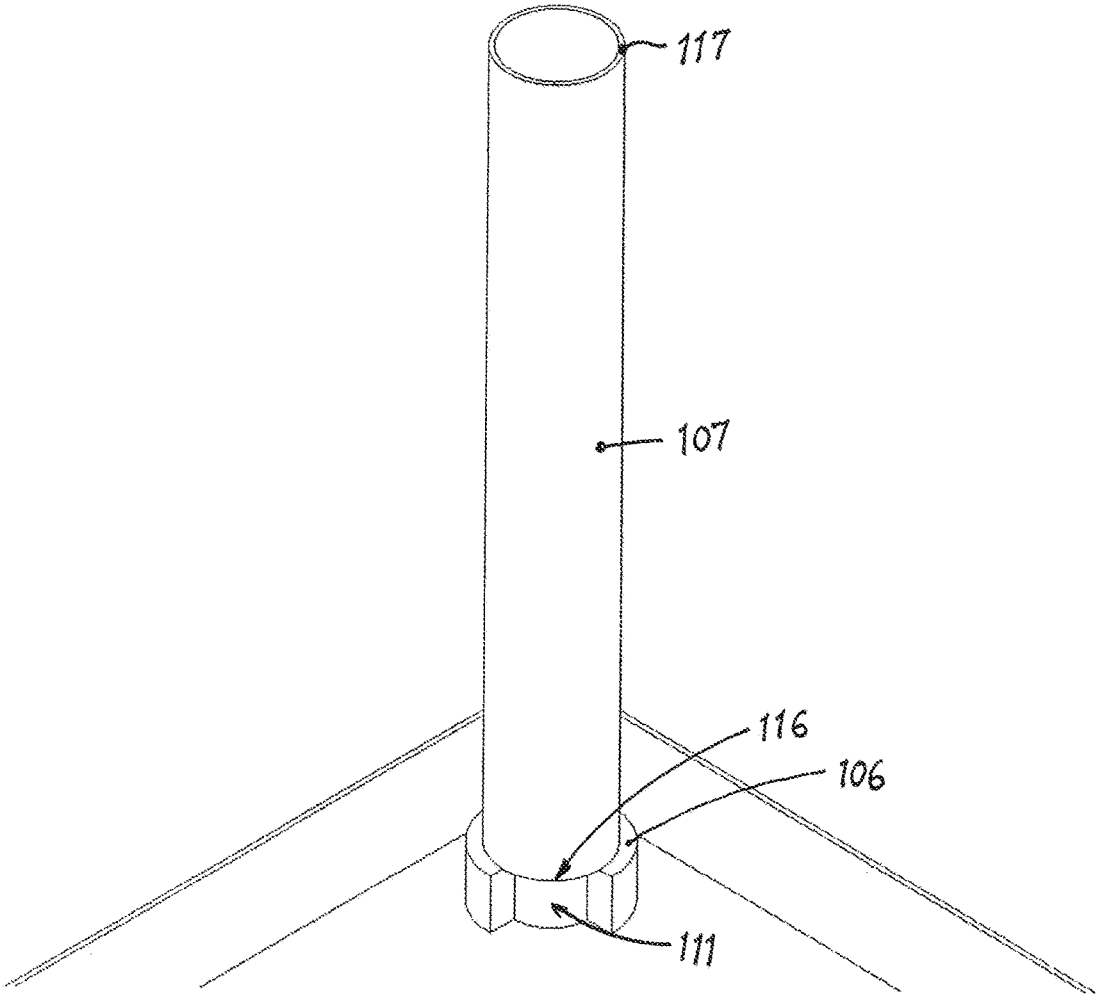
- Fig. 16b -

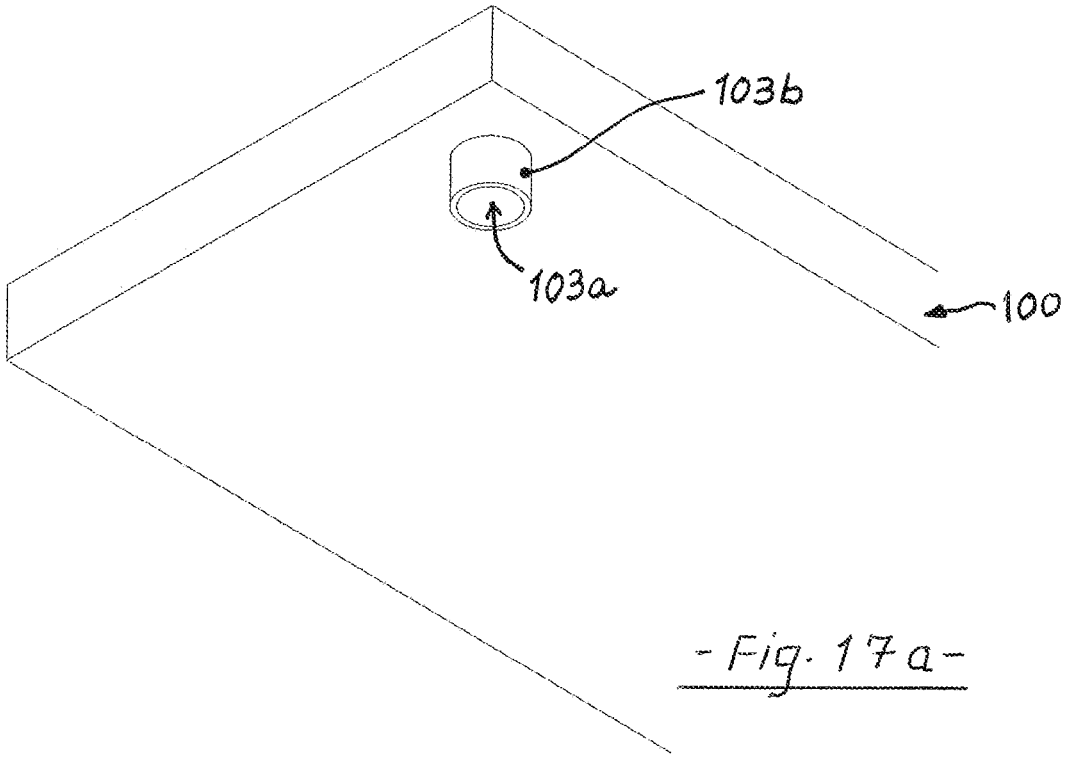
- Fig. 17a -
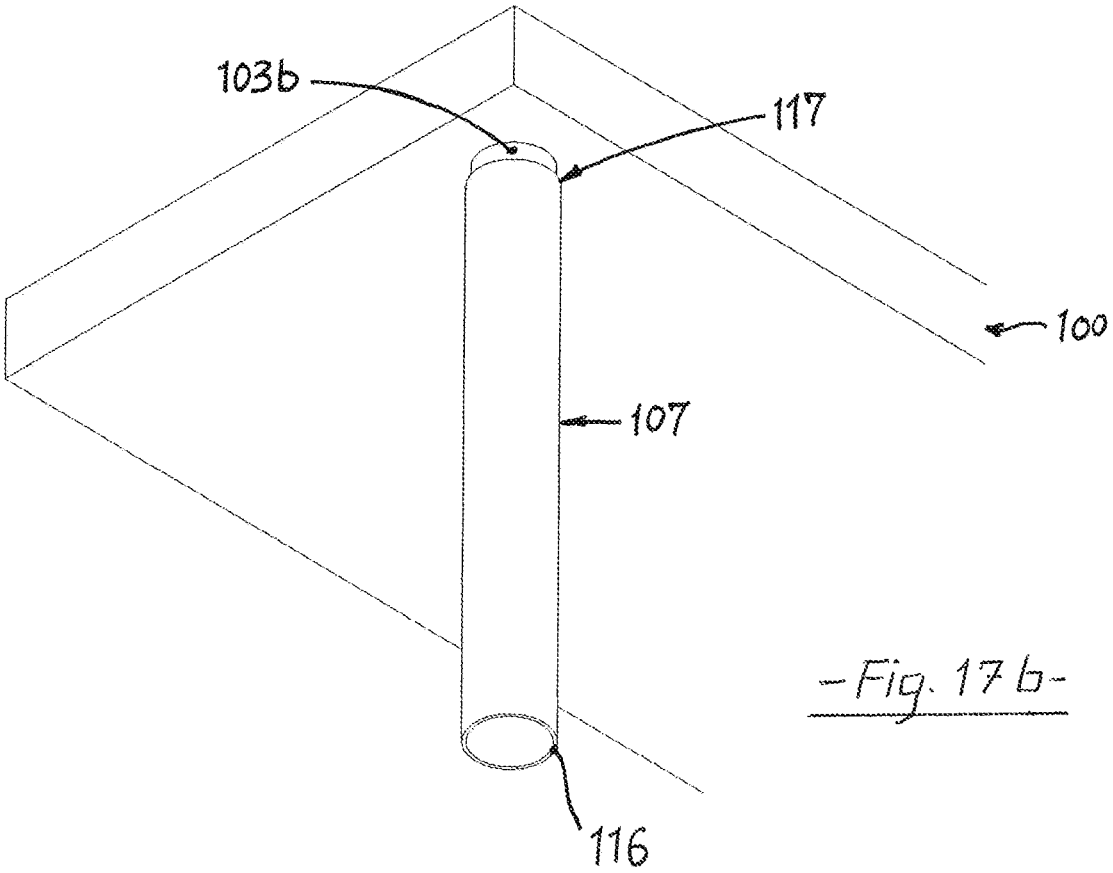
- Fig. 17b -

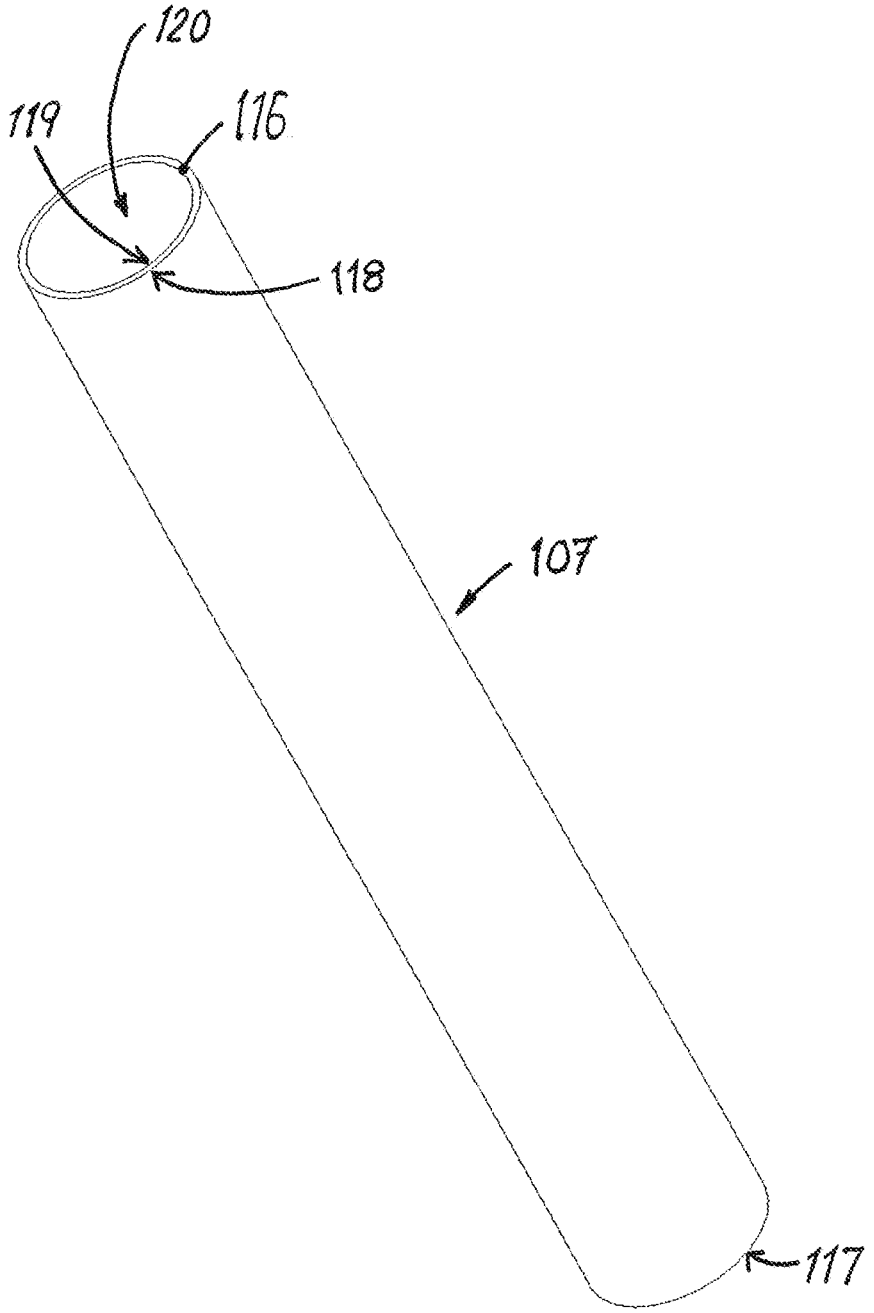
- Fig. 18 -

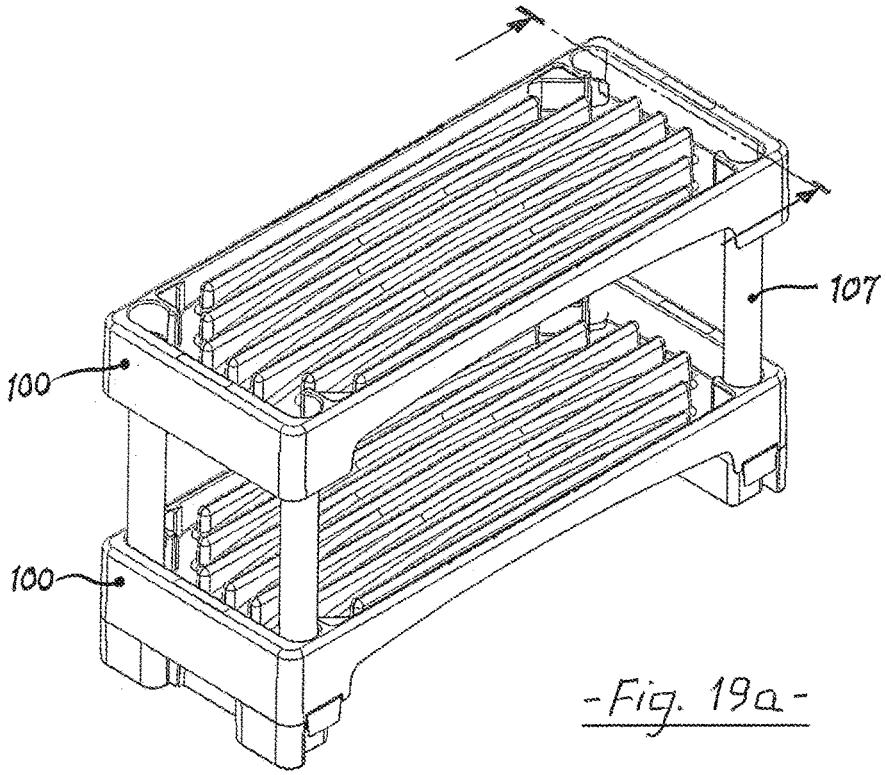
-Fig. 19a-
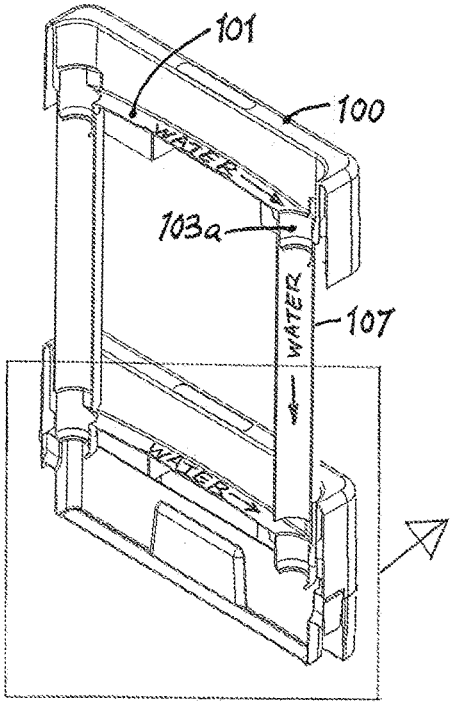
-Fig. 19b-
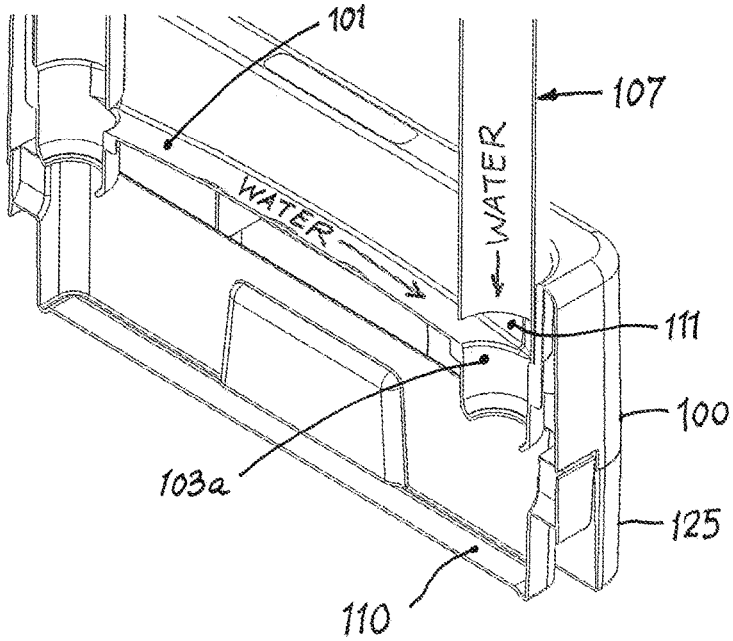
-Fig. 19c-

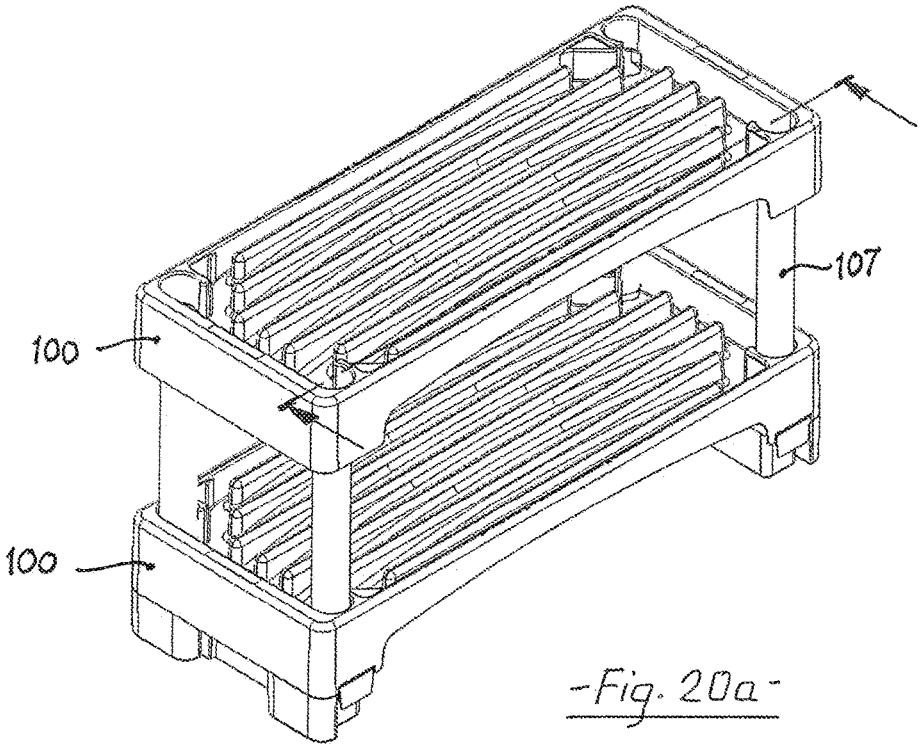
-Fig. 20a-
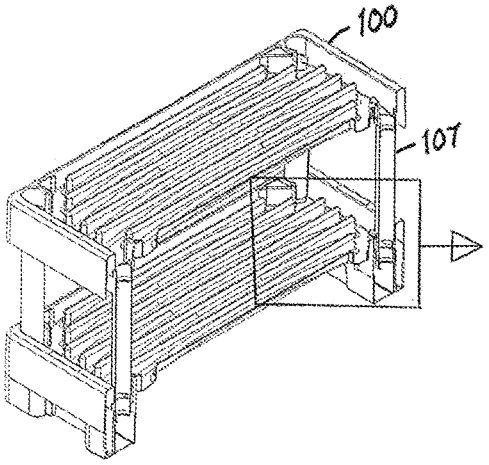
-Fig. 20b-
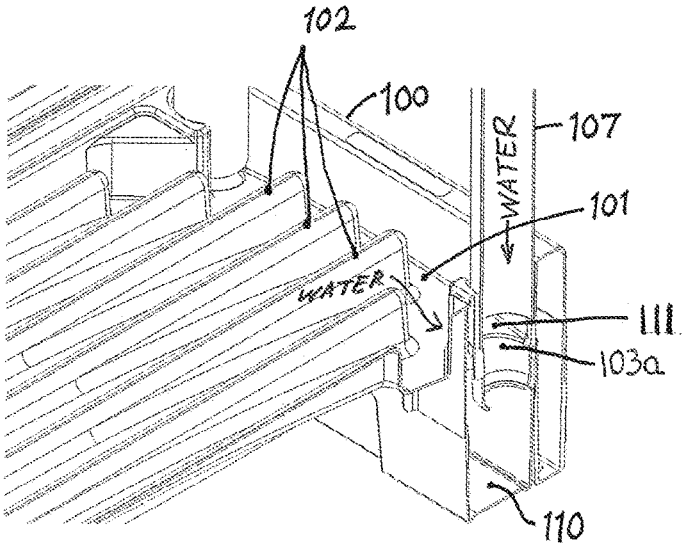
-Fig. 20c-

DRAINING SYSTEM FOR WET OBJECTS ON SINGLE AND MULTI LEVEL TRAYS

BACKGROUND

In winter or in rainy season, snow or water gets on the boots that makes the indoors messy. Often, snow is mixed with dirt and salt and when it comes off the boots, it leaves residue on the floor which is difficult to clean. There are trays available, but they only are meant to contain the waste water and they become pool of waste water over time. By storing boots in such trays dirty water goes back on the floor with the boots. These trays do not address the mess issue effectively. Also, these trays take a lot of floor space. There is a need for a better boot storing system to dry the boots and increase usage of limited floor area to store boots.

SUMMARY

In accordance to first aspect of this invention the draining system comprises of one tray and a waste collection bin placed under the tray. The tray provides a surface to keep the wet objects and provides a passage for waste water to flow from the wet objects into the waste collection bin. The tray has a sloped base member and at least one drain hole. The slope of the base member can be a straight slope or a curved slope. The sloped surface of the base member is made in a way that when water falls on the surface it is directed towards the drain hole. Offset from this sloped surface of the base member there is another virtually flat surface above the sloped surface formed by top of the ribs originating from the sloped surface. This virtually flat surface is designed to receive wet objects. Due to the offset between the virtually flat surface and the bottom sloped surface, waste water from the wet object drips down from the virtually flat surface to the bottom sloped surface by gravity and then it is directed to the drain hole. The virtually flat surface and the bottom sloped surface can be made as one part or two separate parts. The tray is raised from the floor either by built-in feet or by separate feet, the feet makes room to put a waste collection bin under the drain hole of the tray. The waste collection bin receives waste water from the tray. The waste collection bin can be removed for emptying without disrupting the tray and wet objects placed on the tray.

In accordance to second aspect of this invention, the draining system comprises of multiple trays that are stacked one over another in a way that the trays are connected by one or more hollow pillar or pillars and there is a waste collection bin placed under the bottom most tray. The bottom most tray is raised from the floor either by built-in feet or by separate feet, the feet makes room to put a waste collection bin under the drain hole of the bottom most tray. The pillar is a hollow tubular structure with a through hole and two flat ends. The pillar act as support structure as well as a draining connection between each tray. Structure of each tray is same as the tray explained in first aspect of this invention. The drain hole in the tray has a post around it which has a step feature and a side cut-out throughout the post height, this post is designed to receive one end of the pillar. There is a tubular feature around the drain hole on bottom of the tray to receive another end of the pillar. The step feature in the post above the drain hole is designed in a way that when a pillar is assembled in the post a gap is created between the pillar and the sloped surface of the tray so that water from all the trays continues to pass through the drain hole of each tray, then passes through the pillar and then travels into the waste collection bin on the floor level.

In accordance to third aspect of this invention, the waste collection bin as explained in above two aspects of this invention has a built-in electric heater to rapidly evaporate water that comes into the waste collection bin.

DESCRIPTION OF THE FIGURES

In the figures,

FIG. 6 shows a single tray draining system in accordance with the first aspect of the invention, the system comprising a single tray, feet and a removable waste collection bin under the tray;

FIG. 8 shows assembly of the pillar in multi-tray set-up of the draining system and shows flow of waste water through the drain hole with pillar attached to the tray;

FIG. 9 shows exploded view of multi-tray setup of the draining system;

FIG. 10 shows multi-tray setup of the draining system with winter boots placed on each tray;

FIG. 11 shows multi-tray setup of the draining system with dishes and cutlery placed on each tray;

FIG. 12*a* and FIG. 12*b* show a tray of the draining system with built-in feet to raise the tray from floor level to accommodate the waste collection bin under the drain hole;

FIG. 13*a* and FIG. 13*b* show a tray of the draining system with separate feet to raise the tray from floor level to accommodate the waste collection bin under the drain hole;

FIG. 14*a* and FIG. 14*b* show a tray of the draining system with a post having a stepped recess and a side cut-out fused with the boundary wall of the tray;

FIG. 15*a* and FIG. 15*b* show a tray of the draining system with a post having a stepped recess and a side cut-out independently standing on the sloped base member of the tray;

FIG. 16*a* and FIG. 16*b* show a tray of the draining system with a post having a stepped protrusion and a side cut-out independently standing on the sloped base member of the tray;

FIG. 17*a* and FIG. 17*b* show a tray of the draining system with a tubular feature around the drain hole on the bottom side of the tray;

FIG. 18 shows structure of a hollow pillar having two ends;

FIG. 19*a* shows a two-tray set-up of the draining system. FIG. 19*b* shows sagittal cross-section of the unit through the pillar. FIG. 19*c* shows zoomed in view of the sagittal cross-section;

FIG. 20*a* shows a two-tray set-up of the draining system. FIG. 20*b* shows frontal cross-section of the unit through the pillar. FIG. 20*c* shows zoomed in view of the frontal cross-section.

DETAIL DESCRIPTION

Figure 1:
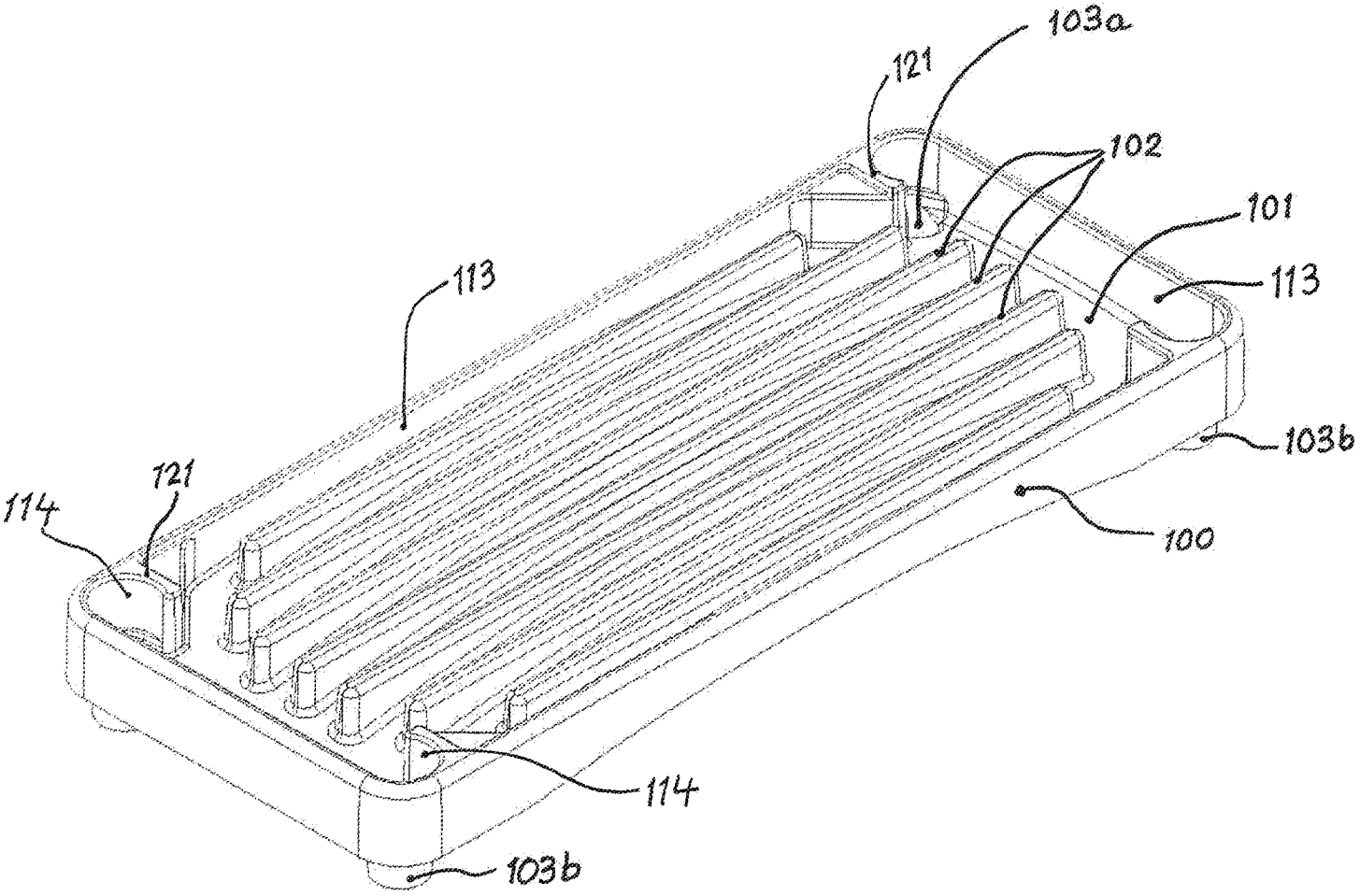
FIG. 1 shows single tray of the draining system.

As shown in FIG. 1 a tray body 100 is rectangular in shape. Tray 100 has a sloped base member 101 and a virtually flat surface above the base member 101 made by peaks of multiple ribs 102. The virtually flat surface formed by the peaks of multiple ribs 102 provides a surface for placing wet objects. The base member 101 of the tray 100 is surrounded by walls 113. In this figure sloped base member 101 and ribs 102 are shown as one part, but they can be separate parts: one part making sloped base and the other part above the slopped base making a flat surface with perforations to allow water to pass through. Base member 101 has four drain holes 103*a* strategically placed at the four corners of the tray 100, these four corners are the bottom-most points of the sloped base member 101. In these illustrations four drain holes are shown, but they can be fewer or more depending on shape and the direction of the slope. Note that the virtually flat surface formed by ribs 102 is higher than sloped base member's surface 101, this height difference allows water to flow from the wet object placed on the virtually flat surface to sloped base surface 101 and then flows towards the drain holes 103*a* by gravity. Drain holes 103*a* are surrounded by tubular features 103*b* at the bottom of tray 100 on the opposite side of sloped base 101. The drain hole 103*a* is surrounded by a post 121 on top of the sloped base feature 101 and is fused with the tray walls 113.

Figure 2:
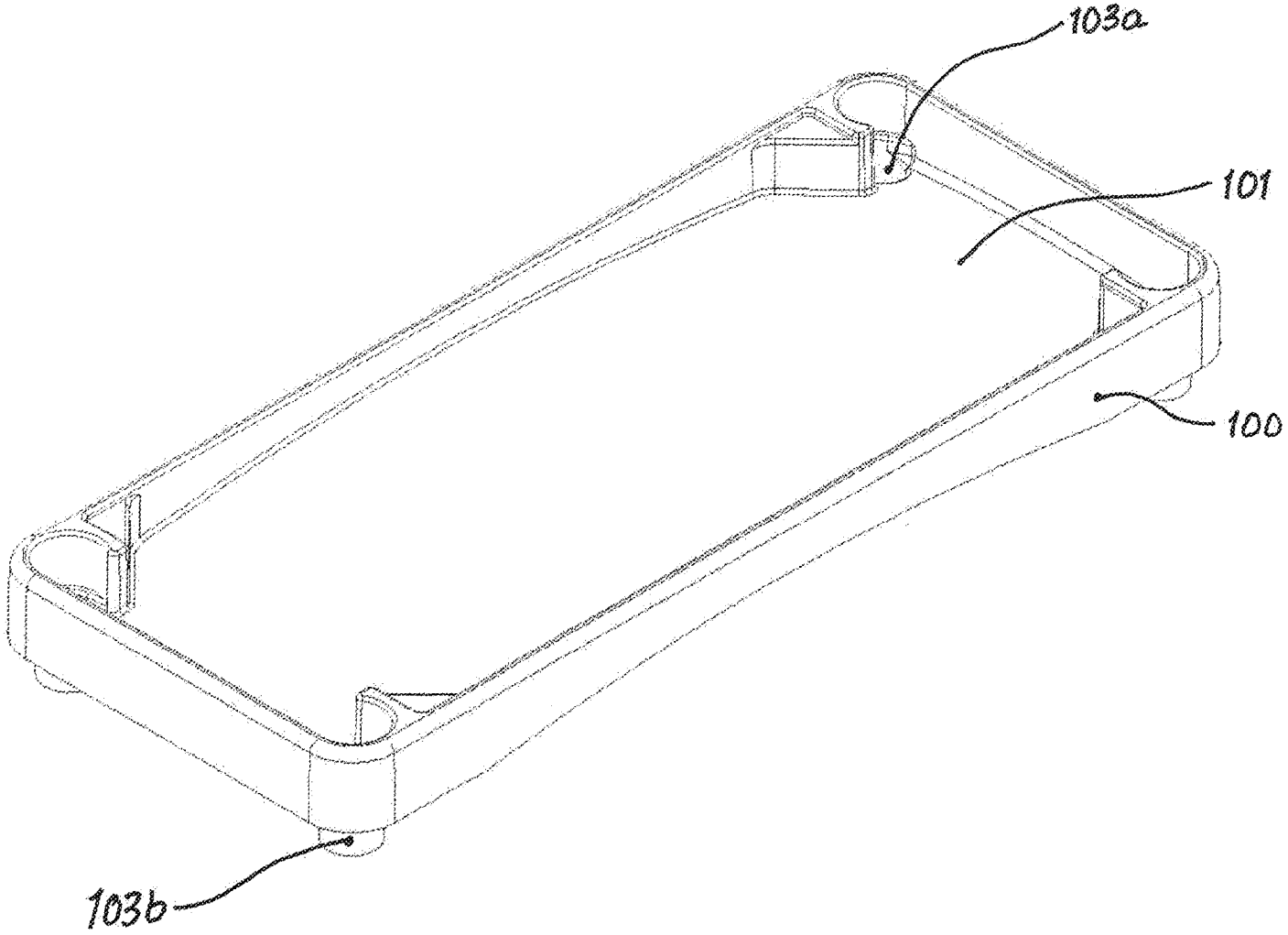
FIG. 2 shows single tray of the draining system without the ribs to clearly demonstrate the sloped surface.

In FIG. 2, flat ribs 102 of the tray 100 are removed to show the sloped base member 101 clearly. In this figure, the sloped base member 101 is shown as a curved profile converging into drain holes 103*a*. Profile of the base member 101 can be a straight inclined profile in one direction or multiple straight inclined profiles in multiple directions. The sloped shape can converge into one drain hole or multiple drain holes.

Figure 3:
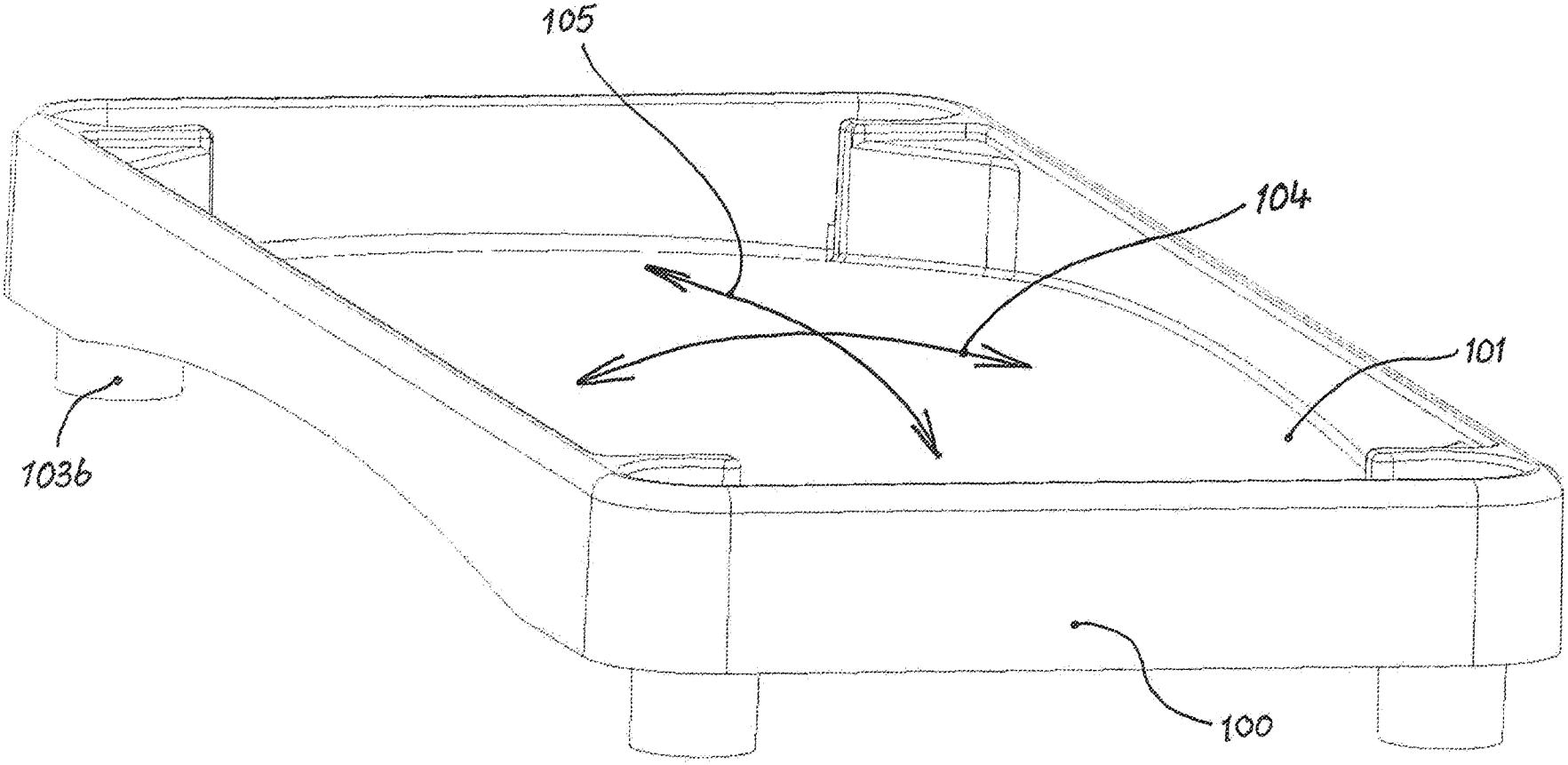
FIG. 3 shows single tray of the draining system without the ribs to demonstrate that the sloped surface is curved in shape.

As shown in FIG. 3, the sloped base member 101 is spherical in shape, having a slope in the direction shown by curve 104 and curve 105.

Figure 4:
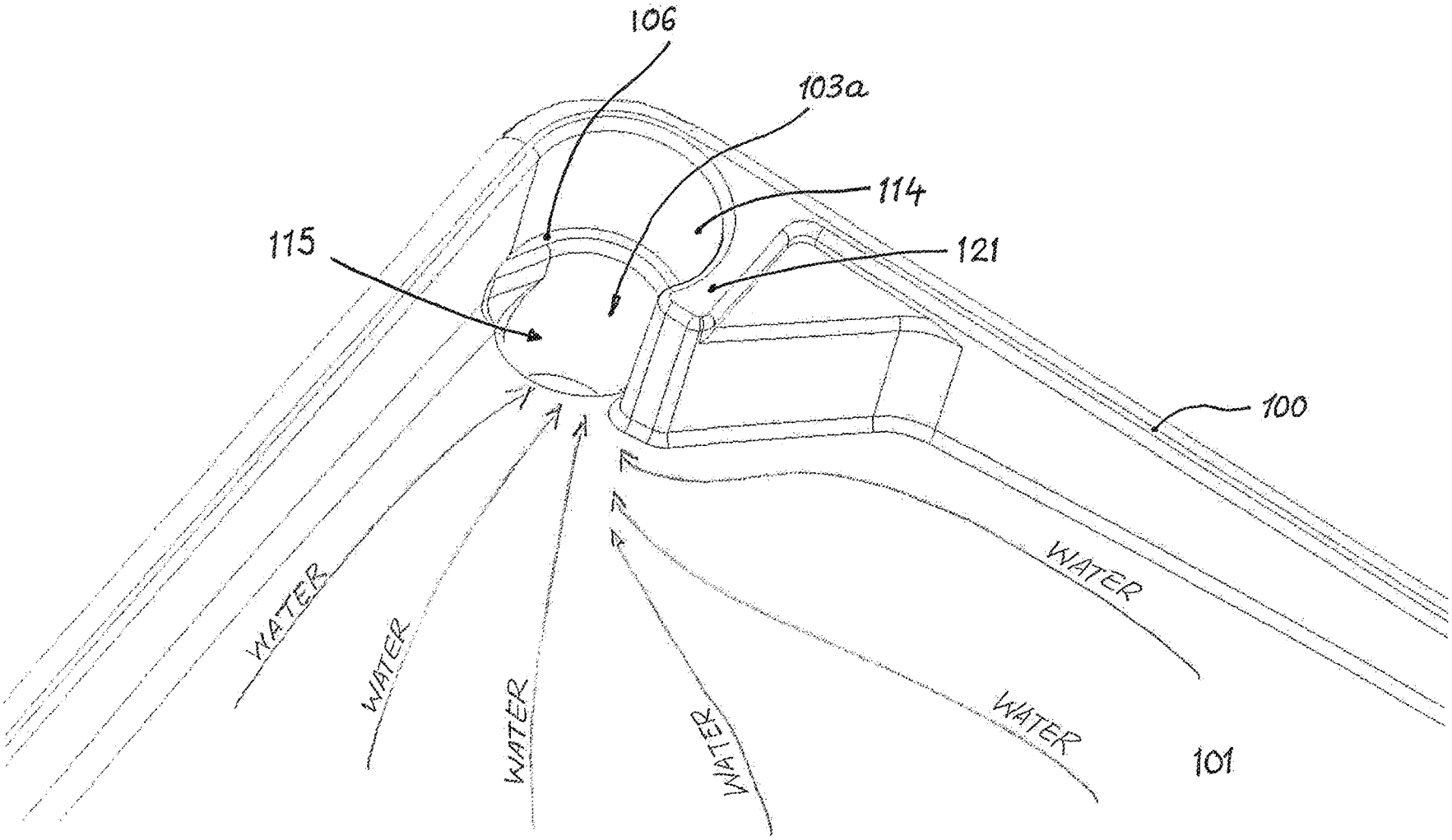
FIG. 4 shows a single tray of the draining system without the ribs and a drain hole in the tray.

FIG. 4 shows the flow of water over the sloped base member 101. Waste water drips off the wet objects placed on the tray 100, flows over the sloped base member and flow into the drain hole 103*a*. FIG. 4 also shows the post 121, the first recess 114 inside the post 121, a side cut-out 115 in post 114 and the step 106 in the post 114 on top of drain holes 103*a*.

Figure 5:
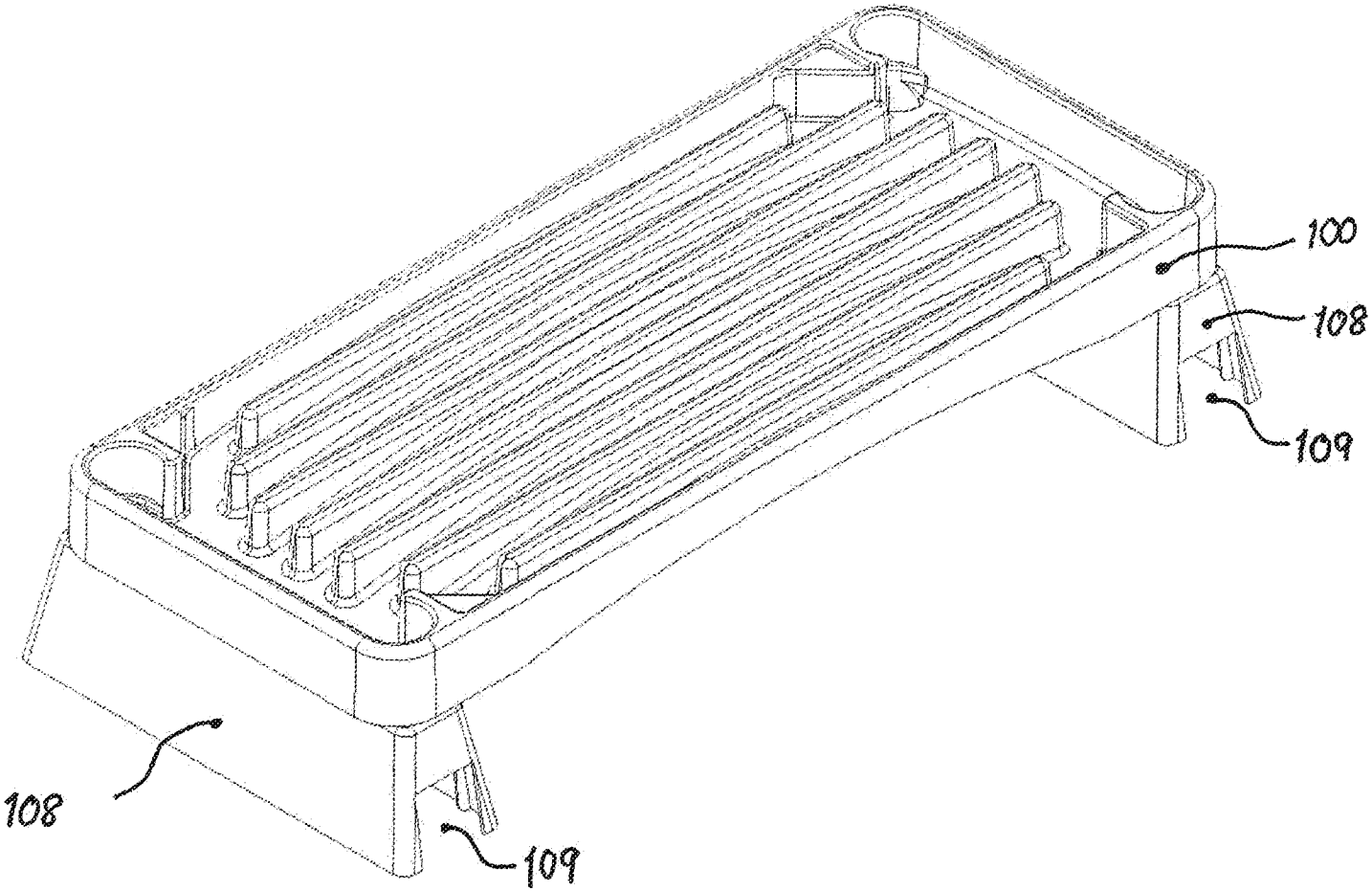
FIG. 5 shows a single tray of the draining system raised from the floor by two feet.

FIG. 5 shows tray 100 raised by two feet 108. These feet 108 raise the tray 100 from the floor to create space 109 under the drain holes 103*a*. In this figure two feet are shown but there could be many variations of raised feet depending on shape and size of trays.

FIG. 6 shows two removable waste collections bins 110 placed under the tray 100. The left waste collection bin 110 is shown in assembled state properly placed under drain holes 103*a* of the tray 100 and the right waste collection bin 110 is shown in a pulled-out state. In this figure one waste collection bin 110 is big enough to collect water from two drain holes 103*a*, but there could be many variations of waste collection bin 110 depending on the number, location and size of drain holes. Waste water passing through the drain holes 103*a* is stored in the waste collection bin 110. Waste collection bin 110 can be removed for emptying and can be re-placed in opening 109 for subsequent water collection.

Figure 7A:
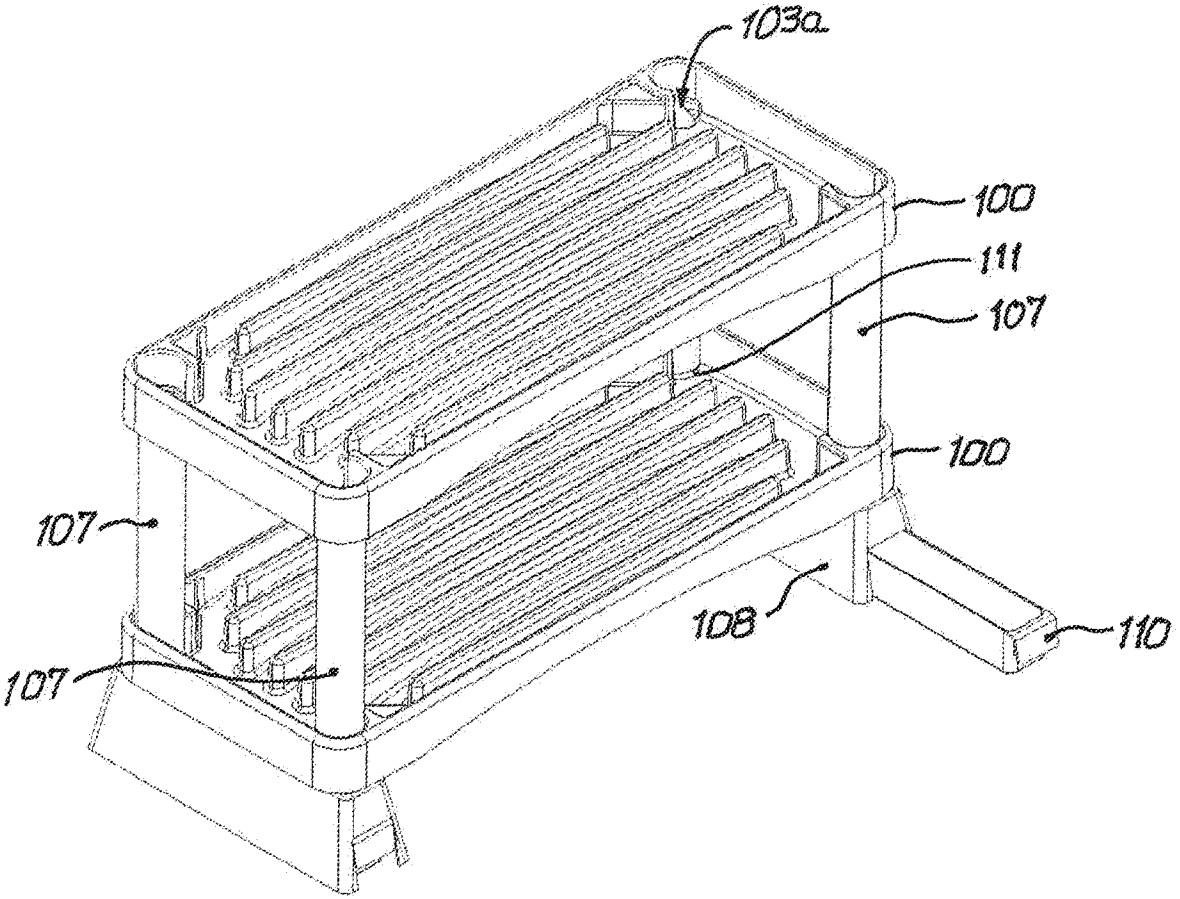
FIG. 7*a* and FIG. 7*b* show multi-tray setup of the draining system in accordance with second aspect of the invention.
Figure 7B:
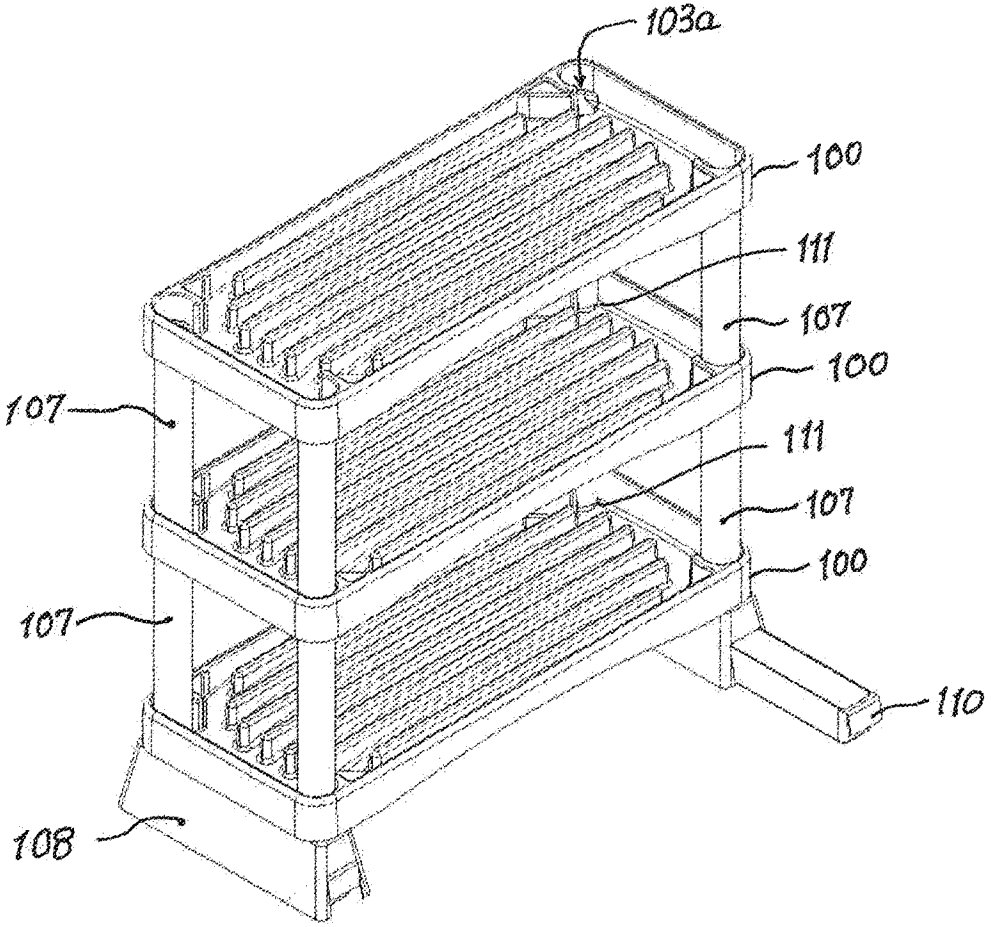

FIG. 7*a* and FIG. 7*b* shows multi-trays setup. As shown in FIG. 7*a* two trays 100 can be stacked one over the other by using pillars 107. FIG. 18 clearly shows the construction of pillar 107. The pillar 107 is hollow with a through opening 120. The pillar 107 has two ends, first end 116 and the second end 117. Outer size 118 of the pillar 107 matches the first recess 114 of the tray post 121 and the inner size 119 of the pillar 107 matches the outer size of tray's tubular feature 103*b* such that first end 116 of the pillar 107 fits inside the first recess 114 of bottom tray 100 and the second end 117 of the pillar 107 fits around the tubular feature 103*b* of the top tray 100. First end 116 of the pillar 107 butts against the step 106 of the tray 100, this assembly of pillar and tray leaving gap 111 between sloped surface 101 and pillar 107 so that waste water from the bottom tray 100 can flow through the drain hole 103*a*. In FIG. 7*a* and FIG. 7*b*, four pillars 107 are shown between two trays, but they can be more than four or less depending on the shape and size of the trays 100 and placement of drain holes in the tray. The pillars 107 provide support to top tray 100 and acts as a draining connection between two trays. This way, trays can be stacked up in two layers as shown in FIG. 7*a* or 3 layers as shown in FIG. 7*b* or even more layers (not shown). Water from top tray 100 flows through the pillar 107, then through the drain hole 103*a* of bottom tray 100, and then into the waste collection bin 110 at floor level.

FIG. 8 clearly shows gap 111 created above the drain hole in bottom tray 100 in multi-tray set-up. Gap 111 allows water from bottom tray 100 to flow through drain hole 103*a*.

FIG. 9 shows an exploded view of three-layer tray setup. In this illustration, there are two holes 112 shown in foot 108. Holes 112 are designed to receive tubular feature 103*b* of bottom tray 100, so that water from drain hole 103*a* can flow through the foot 108, and into removable waste collection bin 110. Holes 112 in foot 108 also act as tray locating holes for assembly purpose. The holes 112 will not be required if the foot is of a different design, an example of such foot is shown in FIG. 12*a*, FIG. 12*b*, FIG. 13*a* and FIG. 13*b*.

FIG. 10 shows a three-layer tray setup with footwear 122 on each layer. This illustration also shows that pillars 107 have created enough space between the two trays 100 to accommodate tall boots 122.

FIG. 11 shows a three-layer tray setup with various dishes and cutlery 123 on trays 100.

FIG. 12*a* and FIG. 12*b* show a tray 100 with built-in feet 124 to raise the tray 100 to make space for the waste collection bin 110 under the drain holes of the tray 100. FIG. 12*b* shows space 109 under the tray 100 to accommodate waste collection bin 110.

FIG. 13*a* and FIG. 13*b* show a tray 100 with separate feet 125 to raise the tray 100 to make space for the waste collection bin 110 under the drain holes of the tray 100. FIG. 13*b* shows the feet 125 in disassembled state and this figure also shows space 109 under the tray 100 to accommodate waste collection bin 110.

FIG. 14*a* and FIG. 14*b* show a post 121 on top of the sloped base member 101. In these figures the post is shown fused with the tray walls 113. The post 121 has a first recess 114, a second recess 126, a step 106 between the two recesses and a side cut-out 115 throughout the post height. The sloped base member 101 has a drain hole 103*a* inside the post 121. FIG. 14*b* shows a pillar 107 assembled into the post 121 such that first end 116 of the pillar 107 fits into the first recess 114 of the post 121 and butts against the step 106. This assembly of pillar 107 and tray post 121 creates a gap 111 for water to flow through drain hole 103*a*. FIG. 14*b* illustrates a multi-layer tray set-up.

FIG. 15*a* and FIG. 15*b* show a post 121 on top of the sloped base member 101. In these figures the post is shown independently standing on the sloped base member 101 and not fused with tray walls 113. The post 121 has a first recess 114, a second recess 126, a step 106 between the two recesses and a side cut-out 115 throughout the post height.

The sloped base member 101 has a drain hole 103*a* inside the post 121. FIG. 15*b* shows a pillar 107 assembled into the post 121 such that first end 116 of the pillar 107 fits into the first recess 114 of the post 121 and butts against the step 106. This assembly of pillar 107 and tray post 121 creates a gap 111 for water to flow through drain hole 103*a*. FIG. 15*b* illustrates a multi-layer tray set-up.

FIG. 16*a* and FIG. 16*b* show a post 121 on top of the sloped base member 101. In these figures the post is shown independently standing on the sloped base member 101 and not fused with tray walls 113. The post 121 has a first protrusion 128, a second protrusion 127, a step 106 between the two protrusions and a side cut-out 115 throughout the post height. The sloped base member 101 has a drain hole 103*a* inside the post 121. FIG. 16*b* shows a pillar 107 assembled onto the post 121 such that first end 116 of the pillar 107 fits onto the second protrusion 127 of the post 121 and butts against the step 106. This assembly of pillar 107 and tray post 121 creates a gap 111 for water to flow through drain hole 103*a*. FIG. 16*b* illustrates a multi-layer tray set-up.

FIG. 17*a* and FIG. 17*b* show bottom view of the tray 100 in a multi-layer tray set-up. FIG. 17*a* shows the tubular feature 103*b* surrounding the drain hole 103*a* on bottom face of the tray 100. FIG. 17*b* shows pillar 107 assembly with the tubular feature 103*b* such that the second end 117 of the pillar 107 fits on to the tubular feature 103*b* of the tray 100.

FIG. 18 clearly shows the construction of pillar 107. The pillar 107 is hollow with a through opening 120. The pillar 107 has two ends, first end 116 and the second end 117. Outer size 118 of the pillar 107 matches the first recess 114 of the tray post 121 and the inner size 119 of the pillar 107 matches the outer size of tray's tubular feature 103*b*. In case of the post 121 described in FIG. 16*a* and FIG. 16*b*, inner size 119 of the pillar 107 matches outer size of the second protrusion 127 of the post 121 and inner size 119 of the pillar 107 also matches the outer size of tray's tubular feature 103*b*.

FIG. 19*a* shows a two-tray set-up of the draining system. FIG. 19*b* shows sagittal cross-section of the unit through the pillar 107. FIG. 19*c* shows zoomed in view of the sagittal cross-section. As shown in FIG. 19*b* and FIG. 19*c* water from the top tray 100 flows on the sloped base member 101, then through the drain hole 103*a*, then through the pillar 107, then through the drain hole 103*a* of the bottom tray and then finally reaches the waste collection bin 110. Also shown in FIG. 19*b* and FIG. 19*c* water from the bottom tray 100 flows on the sloped base member 101, passes through the gap 111, enters the drain hole 103*a* and finally reaches the waste collection bin 110.

FIG. 20*a* shows a two-tray set-up of the draining system. FIG. 20*b* shows frontal cross-section of the unit through the pillar. FIG. 20*c* shows zoomed in view of the frontal cross-section. As shown in FIG. 20*c* water from the top tray 100 flows down through the pillar 107, then through the drain hole 103*a* of the bottom tray and then finally reaches the waste collection bin 110. In the bottom tray 100 water from peaks of the multiple ribs 102 flows down to the sloped base member 101, passes through the gap 111, enters the drain hole 103*a* and finally reaches the waste collection bin 110.

What is claimed is:

1. A draining system for storing wet objects like footwear comprising:

a tray having:

a base member that is enclosed by walls on a top side of the said base member, at least one stepped post above the top side of the said base member with a side cut-out throughout the height of the said at least one stepped post, an opening on the base member inside the said at least one stepped post, a tubular feature on a bottom side of the said base member around the opening, at least one waste collection bin placed under the said tray such that the waste collection bin can be removed without moving the tray above the waste collection bin, detachable feet that are used to raise the tray to accommodate the at least one waste collection bin under the said tray, at least one pillar to connect two of said tray together, one above the other, for stacking purpose.

2. The draining system of claim 1, wherein the at least one stepped post in the said tray comprises of two recesses: a first recess and a second recess, and a step surface in between the first recess and the second recess.

3. The draining system of claim 2, wherein the second recess is below the first recess and the first recess is bigger than the second recess.

4. The draining system of claim 1, wherein the top side of the tray base member is formed in at least two levels: a higher level and a lower level such that the said at least one stepped post is positioned at the lower level.

5. The draining system of claim 4, wherein a step inside the said at least one stepped post is higher than the lower level of the said tray base member.

6. The draining system of claim 4, wherein the height difference between the higher level and the lower level is achieved by creating a curve on the base member.

7. The draining system of claim 1, wherein the tray base member has projections originating from the base member to form a virtually horizontal plane above the base member to place wet objects like footwear.

8. The draining system of claim 1, wherein the said detachable feet can be separated from the tray.

9. The draining system of claim 1, wherein the at least one stepped post is fused with the walls surrounding the top side of the said base member of the tray.

10. The draining system of claim 1, wherein the said at least one pillar has a through opening along a length and has two ends: a first end and a second end.

11. The draining system of claim 10, wherein an outer size of the said at least one pillar matches inner size of the said at least one stepped post.

12. The draining system of claim 10, wherein an inner size of the said at least one pillar matches an outside size of the said tubular feature on the bottom side of the said tray.

13. The draining system of claim 10, wherein stacking of said trays is achieved by inserting the first end of the said at least one pillar inside the said at least one stepped post of the said tray at the bottom and by inserting the said tubular feature of the tray at the top inside the second end of the said at least one pillar.

14. The draining system of claim 13, wherein the first end of the said at least one pillar makes contact with a step inside the said at least one stepped post.

15. The draining system of claim 13, wherein a gap is created between the first end of the said at least one pillar and the top side of the said base member of the said tray at the bottom.

* * * * *